United States Patent [19]

Rezmer

[11] Patent Number: 4,599,987

[45] Date of Patent: Jul. 15, 1986

[54] BON STRING CHANGER

[75] Inventor: Leonard D. Rezmer, Kawkaw, Mich.

[73] Assignee: The Game Tracker, Inc., Flushing, Mich.

[21] Appl. No.: 676,438

[22] Filed: Nov. 29, 1984

[51] Int. Cl.[4] ..... F41B 5/00; B21F 9/00

[52] U.S. Cl. ..... 124/23 R; 124/DIG. 1; 254/254

[58] Field of Search ..... 124/23 R, 24 R, DIG. 1; 254/255, 254, 242, 243; 24/135 N; 403/393, 396, 362

[56] References Cited

U.S. PATENT DOCUMENTS 289,334 11/1883 Brewer ..... 24/135 N 1,273,922 7/1918 Prattinger ..... 24/135 N 1,456,824 5/1923 Olson ..... 403/396

3,294,078 8/1963 Allen ..... 124/23 R

*Primary Examiner*—Richard C. Pinkham

*Assistant Examiner*—Benjamin Layno

*Attorney, Agent, or Firm*—Basile, Weintraub, Hanlon

[57] ABSTRACT

A bow press for facilitating the re-stringing of a split limb bow includes a pair of spaced apart handles which engage the exterior of the limbs via the slots formed therein. A rotatable lever to which the handles are interconnected, when rotated from a first position to a second position, causes inward compression of the limbs toward each other. An adjustment rod, which is variable in length, reduces or extends the length between the two handles to accommodate bows of various sizes.

4 Claims, 3 Drawing Figures

BON STRING CHANGER

BACKGROUND OF THE INVENTION

1. Field of the Invention

The present invention pertains to archery equipment. More particularly, the present invention concerns apparatus for facilitating the re-stringing of bows. Even more particularly, the present invention concerns devices for facilitating the re-stringing of split limb bows.

2. Prior Art

Split limb bows are well-known archery devices which incorporate a cable and pulley system. The pulleys are mounted, in opposed or spaced apart relationship, onto the opposed limbs of the bow and are used to facilitate the drawing of an arrow. The cable is "strung" around the pulleys. The pulleys are mounted in slots or splits formed in the free end of each limb of the bow. The bows which employ this type of system are compound bows, and are called split limb bows because of these splits.

Oftentimes, and as is known to those skilled in the art to which the present invention pertains, it is necessary to re-string the bow. This is a cumbersome job because of the tension ordinarily exerted against the cable or string by the inherent resiliency of the bow. In order to re-string such a bow it is necessary to compress the limbs toward each other so that the pulleys can be removed. Maintaining the compression to enable this change is a difficult task, especially in an open field environment.

Heretofore, the prior art has proposed certain devices for facilitating the re-stringing. One such prior art device is illustrated in FIG. 1 hereof. According to FIG. 1 there is provided a device 10' which includes a pair of spaced apart handles 12' which are insertable into the opposed openings or splits in the bow limbs and are engageable therewith. First and second adjustable cords 18' extend from each handle and are mounted to a medial lever 20'. In order to adjust the length of the cords to accommodate various bow sizes a setting block 22' is associated with one of the cords. The cord extends through and is looped around the block to form a substantially closed loop arrangement. To lengthen or shorten the loop the setting block is moved axially, as required. When the proper length of cord is achieved a set screw 24' locks the block in position against the cord so that it cannot move. Then, the medial lever is rotated to a position parallel to the cords. Rotation of the lever causes compression of the limb arms. A lock ring 26' is, then, engaged with the medial lever to hold it in position. Rotation of the lever, as noted, causes compression of the limbs to facilitate the de-mounting of the cables and, therefore, the re-stringing.

An inherent drawback in this prior art device is in the adjustability of the length. As noted, a closed looped cord is employed in order to adjust the span or length of the device. Because of the strength of the cord, and whatever inherent rigidity it has, this adjustment process is difficult and cumbersome.

As will subsequently be detailed, the present invention seeks to improve upon this prior art device by improving upon the ability to adjust the length of the cord.

SUMMARY OF THE INVENTION

In accordance with the present invention there is provided a portable bow press and string changer which generally comprises: (a) first and second handle portions each adapted to engage one arm or limb of a split limb bow; (b) a rotatable lever or lever arm movable between a first position and a second position, the second position causing inward compressing movement of the limbs; (c) first means interconnecting one of the handles to the lever arm; (d) second means interconnecting the other handle to the lever arm, and (e) means for variably adjusting the distance between the handles. A fixed length cord extends from one of the handles to the lever arm to define the first interconnecting means. A slidably adjustable rod extends from the opposed or second handle and is connected thereto. A medial cord extends therefrom to the lever arm to define the second interconnecting means. Means for adjusting the length of the rod is mounted thereonto.

By providing an adjustable rod and means for locking the rod in the adjusted length position, adjustment of the device to vary the distance between the handles is greatly facilitated.

A lock ring is mounted onto one of the cords and retains the lever arm in a locked position.

Compression of the limbs is achieved by rotation of the lever to the second position which is parallel to that of the cords.

For a more complete understanding of the present invention reference is made to the following detailed description and accompanying drawing. In the drawing like reference characters refer to like parts throughout the several views in which:

DESCRIPTION OF THE PREFERRED EMBODIMENTS

Figures 1, 2, 3:
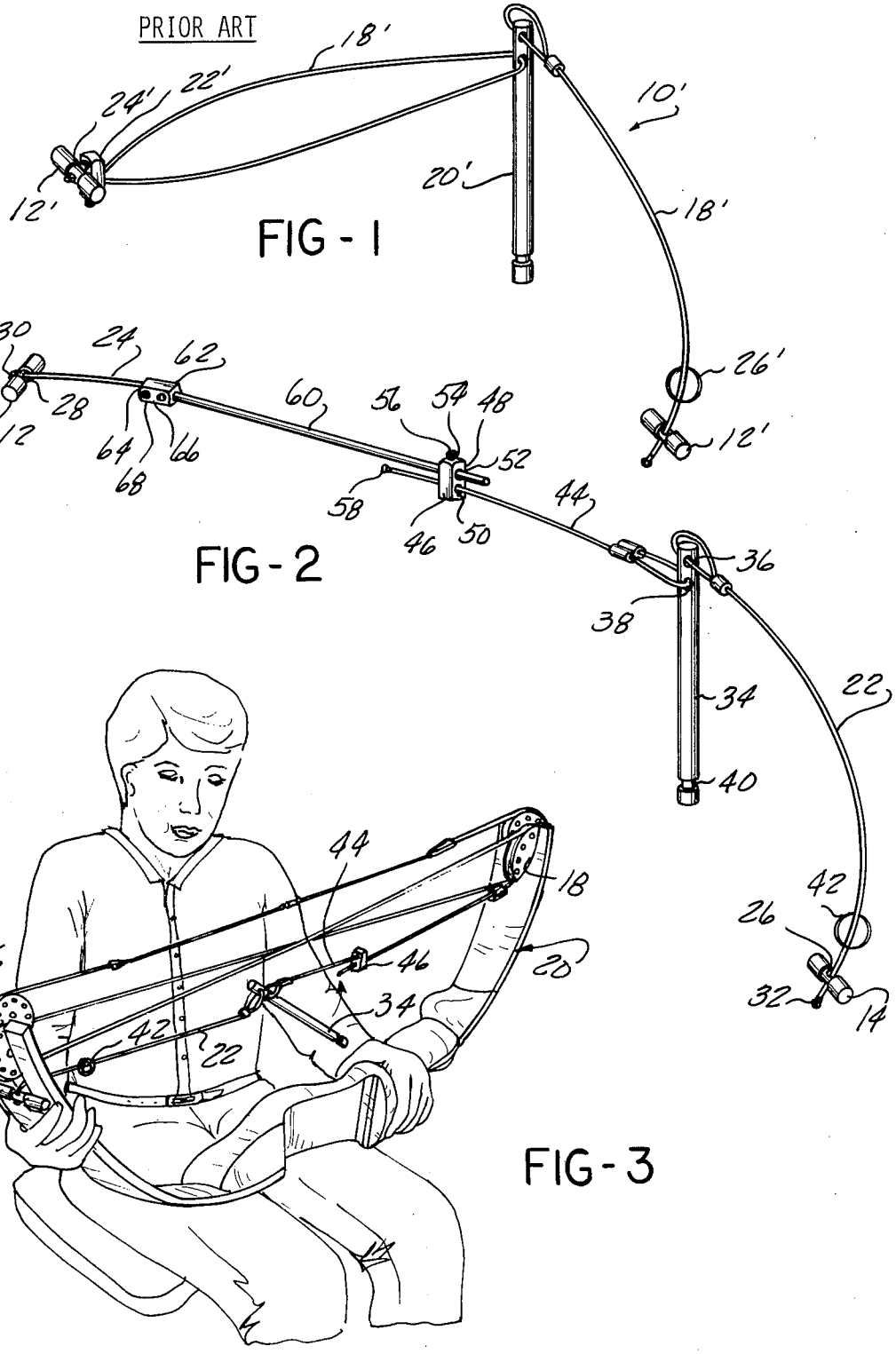
FIG. 1 is a perspective view depicting a prior art device.
FIG. 2 is a perspective view of a device in accordance with the present invention.
FIG. 3 is a perspective view showing the present device in use.

Now, and with reference to the drawings, and, in particular, FIGS. 2 and 3, there is depicted therein a bow press in accordance with the present invention and, generally, indicated at 10 for use with a split limb compound bow 20. Each limb of the bow has a slot or split 16, 18 at each free end thereof, as shown.

The bow press 10, as shown, generally, comprises a pair of spaced apart handles 12, 14 each of which is adapted to seat within an associated limb opening 16, 18 of the split limb bow 20.

Each handle is slidably mounted onto a length of cord 22, 24 associated therewith.

Each handle has an opening 26, 28, respectively, through which extends the free or terminal end of the associated cord 22 or 24.

The terminus of each cord has a nob or cap 30, 32 which has a diameter greater than that of the associated opening to prevent the handle from sliding off the cord.

The cord 22 has its other or opposite end secured to a rotatable lever arm 34. The cord 22, thus, defines a first means for connecting one of the handles to the lever or lever arm 34.

The lever arm, which is an elongated rod, has a first end provided with a pair of spaced apart openings 36, 38. The end of the cord 22 projects through one of the openings 36 or 38 and is wrapped therearound and secured unto itself, as shown, to secure the cord to the lever arm in a closed loop, fixed-length manner.

The other or opposite end of the lever arm 34 has a circumferential groove 40 which is used, in cooperation with a locking ring 42, to maintain the lever arm in a locked position in a manner to be described subsequently.

As shown in the drawing, the locking ring 42 is mounted onto the cord 22. The locking ring comprises any suitable circular member or other suitably configured member which can seat within the groove 40.

The present device, also, includes an intermediate or medial cord 44. The intermediate cord has a first end which projects through the opening 38 formed in the lever 34 and is looped therethrough and secured back onto itself by any suitable means. The opposite or other end of the cord projects through and is interconnected to a setting or locking block 46.

The locking block 46 comprises a body member 48 having a pair of spaced apart openings 50, 52 formed therethrough. The openings 50, 52 have parallel horizontal axes and are axially spaced apart along a vertical axis of the body member 48. A third or top opening 54 is also formed in the body member 48. The opening 54 communicates with the opening 52. The opening 54 is internally threaded to receive a set screw or other fastening means 56, for purposes to be described subsequently.

As shown in the drawing, the free or terminal end of the cord 44, which projects through the opening 50, has a cap 58 secured to the free end thereof. The cap 58 has a diameter greater than that of the opening 50 associated therewith to prevent the intermediate cord 44 from being disconnected from the assembly. The fixed-length, intermediate cord 44 is freely slidable through the opening 50 between the termini thereof.

Extending through the opening 52 is an adjustment rod 60. The rod 60 has a diameter less than that of the opening 52 and is thus projectable therethrough along the length thereof. One end of the rod 60 has a second locking block 62 mounted thereonto such as by threading or the like.

The free end of the fixed-length cord 24 is secured to the locking block 62. This can be achieved by forming an opening 64 therein through which is projected the free end of the cord 24. A second opening 66 normal to the opening 64 opens into communication therewith. A suitable fastening means such as a set screw 68 can then be inserted through the opening 66 and tightened against the free end of the cord 24 to lock it in position.

It is, thus, seen that the interconnections between the cord 24, the adjustable bar or rod 60 and the cord 44 to the lever arm 34 defines a second means for intercoonnecting the handle 14 to the lever arm 34.

Likewise, the positionability of the setting or locking block 46 on the adjustable rod 60 causes variation in the distance between the handles 12, 14 and, thus, the block 46 and fixed-length rod 60 defines means for varying the distance between the handles 12, 14.

As shown in FIG. 3, the present device is employed as follows: the adjustment rod 60 is loosened against the tension of the fastener 56 so that it is freely slidable within the associated opening 52 and is extended a length such that the handles 12, 14 can rest against the outer face of the limbs of the bow 20. Then, the fastener 56 is tightened against the rod 60 to lock it in position. At this point in time, there is no tension being applied against the limbs of the bow.

Thereafer, the arm or lever 34 is rotated into a plane parallel with that of the cord 22. The rotation of the lever causes compression of the limb arms such that they are inwardly directed toward each other. Then, the locking ring is slipped into the groove 40 to maintain the lever 34 in a compression exerting position. In this manner, the pulleys can then be released from the slots and the bow string removed and replaced. After this is done and the pulleys are re-mounted, the locking ring is slipped out of the groove and the lever arm is rotated back to its normal position.

It should be noted in this regard that in a normal position the lever arm, at rest, is at an angle of about 45° with respect to the horizontal plane.

It is apparent that the present device 10 enables easy, on-site re-stringing of a split limb bow.

Having, thus, described the invention what is claimed is:

1. In a device for facilitating re-stringing of a split limb bow, the improvement which comprises:

a pair of spaced apart handles each handle adapted to engage an associated exterior surface of a limb through a slot formed therein;

a rotatable lever arm movable between a first position and a second position, the second position causing inward compressing of the bow limbs;

a first means for interconnecting one of the handles to the lever arm;

a second means for interconnecting the other of the handles to the lever arm; and means for variably adjusting the distance between the handles comprising:

an adjustment rod;

a locking block, the locking block being slidably positionable along the length of the rod; and fastening means for locking the locking block in a desired position along the length of the rod.

2. The improvement of claim 1 which further comprises:

means for locking the rotatable lever arm in the second position.

3. The improvement of claim 2 wherein the means for locking comprises:

a ring slidably mounted on one of said means for interconnecting the handles to the lever arm;

the lever arm having a groove formed therein; and wherein the ring engages the groove when the lever arm is in the second position to retain the lever arm in the second position.

4. The improvement of claim 1 which further comprises:

a first cord extending between one of the handles and the lever arm, the cord defining the first means for interconnecting one of the handles to the lever;

an intermediate cord extending between the means for variably adjusting the distance and the lever arm, the means for variably adjusting being connected to the other handle, the intermediate cord cooperating with the means for variably adjusting to define the second means for interconnecting the other handle to the lever arm.

* * * * *